United States Patent [19]

Teckmeyer et al.

[11] 4,392,868

[45] Jul. 12, 1983

[54] GASOLINE FUEL EXTENDER FORMULATION

[76] Inventors: Fred W. Teckmeyer, 158 Delaware Dr., Coraopolis, Pa. 15108; George K. Dorn, 1606 W. 15th St., Beaver Falls, Pa. 15010

[21] Appl. No.: 316,352

[22] Filed: Oct. 29, 1981

Related U.S. Application Data

[63] Continuation-in-part of Ser. No. 173,915, Jul. 31, 1980, abandoned.

[51] Int. Cl.[3] ..... C10L 1/18

[52] U.S. Cl. ..... 44/56

[58] Field of Search ..... 44/56

[56] References Cited

U.S. PATENT DOCUMENTS 1,423,048 7/1922 Tunison ..... 44/56

1,474,982 11/1923 Schreiber ..... 44/56

3,869,262 3/1975 Mayerhoffer et al. ..... 44/56

4,154,580 5/1979 Landis ..... 44/56

*Primary Examiner*—Charles F. Warren

*Assistant Examiner*—Y. Harris-Smith

*Attorney, Agent, or Firm*—Parmelee, Miller, Welsh & Kratz

[57] ABSTRACT

A homogeneous combustion engine fuel extender fuel formulation has been provided for blending with gasoline as a relatively inexpensive substitute therefor in an amount of not greater than about 50% by volume. Although employing ethanol and naphtha, it is formulated in such a manner that disadvantages of naphtha and ethanol as used alone have been avoided and that gasoline containing the extender will have substantially the same working characteristics as commercial leaded and unleaded gasoline, requiring no changeover or adjustment of engine components when used alternately with 100% commercial gasoline. Basically, the formulation involves a critical solution content of an aliphatic naphtha, ethanol and a higher alcohol.

11 Claims, 2 Drawing Figures

Figure 1:
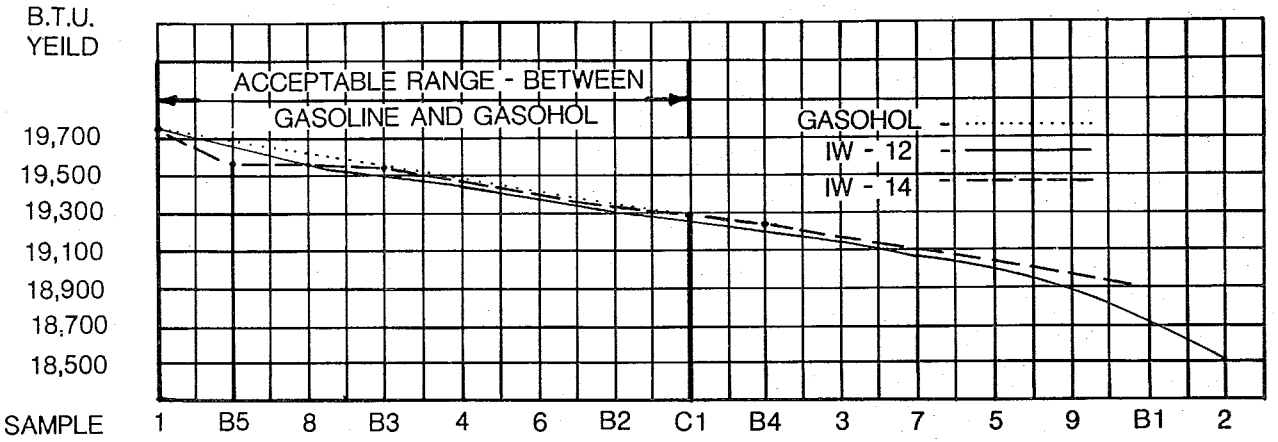

KEY
(BOTH GRAPHS)

GASOLINE

60% GAS/40% IW-14

GASOLINE FUEL EXTENDER FORMULATION

FIELD OF THE INVENTION

This is a continuation-in-part of our application Ser. No. 173,915 of July 31, 1980, now abandoned.

This invention has been devised to overcome and meet the heretofore encountered limitations on the use of additives to gasoline to function as extenders, for example, the use of chemical additives such as ethyl alcohol and the like blended with gasoline as a motor fuel. At the present time, a relatively small amount of ethanol is being used of, for example, about 5% to 10% as a so-called gasohol blend, without adversely effecting the operation of automobile engines, or requiring adjustment or redesign of carburetor or other components. Gasohol has found some acceptance, particularly in agricultural areas where alcohol can be locally distilled, and also due to waiver of taxes with reference thereto.

Although performance problems are usually not severe, as long as the percentage of the alcohol is less than 15% in the blend, there is a problem from the standpoint of fuel phase separation. It is well recognized that condensation of moisture will not only occur in a partially filled fuel tank from which fuel is to be dispensed, but also that alcohol (ethanol) has the property of infinite solubility in water with even a small percentage of water being sufficient to draw out alcohol in a fuel mixture blending action. In this connection, we define "crack-out" as a significant, about 50% or more, take-up of alcohol in solution that results in a separate bottom layer of alcohol dissolved in water. Although such a mixture is heavier than gasoline and will tend to settle to the bottom of a fuel tank, agitation occurring in fuel take-off or vehicular movement will tend to cause engine stalling.

The formulation of the invention is inexpensive and may be used up to a maximum of about a 50 to 50 part by volume ratio with gasoline without the need for changing the carburetor fuel mixture adjustment or making other adjustments, such as of the ignition timing, spark, etc. Importantly, it also may be used without danger of damage to gaskets, gasoline hoses, etc. that occurs in the presence of methanol, acid-like ingredients, and acetals (ethers), all of which have been found to be unsuitable. Methanol, although an inexpensive alcohol, is definitely precluded since it will not properly mix with the naphtha content of our formulation and also tends to dissolve hoses, gaskets, etc. Acetone has a great affinity for absorbing water and an acid forming tendency. Ethers are too volatile and wash lubricants off engine walls; other ingredients, such as aldehydes have bad exhaust emissions which raise a problem as to compliance with present day emission requirements. Acid forming ingredients are not only destructive of the equipment but have bad emissions.

DESCRIPTION OF THE PRIOR ART

The prior art is represented by such references as U.S. Pat. Nos. 1,474,982 of Schreiber, 1,423,048 of Tunison, 3,869,262 of Mayerhoffer et al. and 4,154,580 of Landis.

Schreiber is concerned with the provision of a new type of fuel mixture which may contain methyl alcohol as well as ethyl alcohol, benzol, ether and toluol, the purpose being to provide a fuel that will not freeze. Tunison provides a fuel for use in diesel engines which contains a heavy hydrocarbon (that is heavier than kerosene) and lighter components, such as an alcohol, ketone and an ether. Mayerhoffer et al. is concerned with providing an up to 12% additive for ordinary gasoline which will produce a reduced amount of carbon monoxide in the exhaust gas and increase the fuel octane to eliminate a need for tetraethyl lead. Several examples are given which include large percentages of methylal, methanol, etc. Landis is concerned with producing a gasoline of higher octane using a blend containing methanol and several low molecular weight alcohols of up to 20% by volume.

Figure 2:
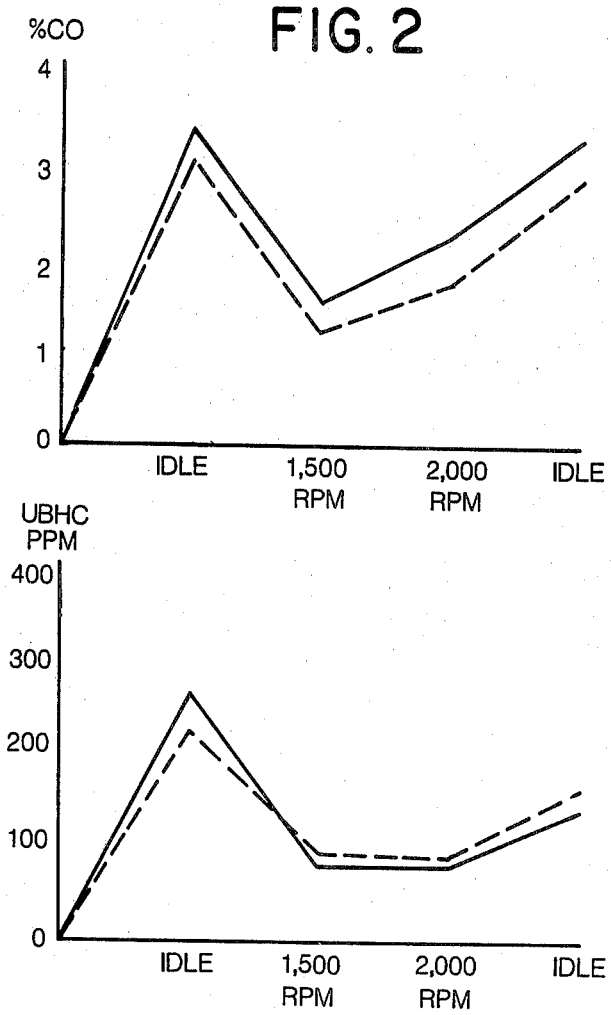

FIGS. 1 and 2 of Drawings are charts illustrating the tabulated experiments represented by Table A and Table B.

SUMMARY OF THE INVENTION

There has been a need for a gasoline fuel extender or solution (formulation) or composition which will, without any engine or carburetor adjustment, enable its use in a much higher percentage with gasoline than is practical under today's conditions, all to the end that a motorist may, without running into difficulty, fill his tank with 100% gasoline or, in the alternate, where available, with a gasoline plus extender mixture which contains a formulated solution substitute up to approximately 50% of its total content.

In endeavoring to provide a solution to the problem as presented, we determined that the solution composition to be used has to eliminate or at least greatly reduce or minimize difficulties heretofore encountered in endeavoring to provide a stable gasoline mixture for vehicular usage, and whose content will not crack-out in the presence of water. The mixture should be practical for normal as well as high and low ambient driving temperature usage, should avoid damage to or clogging of conventional automotive fuel systems and primarily, should have substantially full phase stability in its utilization. Further, it should provide a comparable, mileage rating to that of gasoline, without forming excessive carbon and other pollutants, and should have starting and smooth running qualities of ordinary leaded or lead-free gasoline, as well as a comparable B.T.U. content.

At first, it appeared that the attainment of such a formulation represented an insurmountable or unattainable accomplishment. However, after much experimental work and development and some surprising discoveries, we have been able to develop a fuel composition or gasoline substitute solution which effectively meets the above requirements and which amazingly, in the formulated relation of its ingredients, has characteristics that are foreign to adverse characteristics of its individual elements and, particularly, as provided in accordance with critical criteria involved in its development.

The ingredients used in the solution are of a type that may be produced or made available independently of the use of scarce oil or petroleum and that can be provided by grain, coal and sources that are fully available in this country. Naphtha of a special type is the principal or base ingredient of the solution, being provided in greater proportioned relation than the other ingredients. Of secondary importance, is its ethanol content and this content as essentially proportioned to a higher alcohol in the nature of anhydrous isopropyl alcohol. For maximum phase stability, anhydrous isopropyl alcohol is used. In attaining the formulation, it was also found essential to provide a solution that in its composite state will not only be stable from the standpoint of the presence or introduction of water, but that will have a specific gravity closely approaching that of ordinary commercial unleaded and leaded gasoline which may be in the range of about 0.720 to 0.770.

In the above connection, a difference between the specific gravity of the formulated solution and that of gasoline with which it is to be mixed should not be greater than about 5%, but preferably within a range of about ±2%. An optimum is represented by a 1% or less variation. This assures a full stability when the gasoline and the formulated solution are mixed and assures a clear formulation. A specific gravity of approximately 0.728 to 0.746 is typically attained by our formulated solution, although the two alcohol ingredients thereof, in themselves, have individually much higher specific gravities; this represents a maximum variation of about 1½% with respect to so-called commerical lead-free or white gasoline. The alcohol content as proportioned with respect to each part thereof and with respect to the naphtha results in a solution that has high phase stability in the presence of water.

The naphtha which has been found to be suitable in providing the formulation of the invention is a low octane aliphatic naphtha consisting of $C_7$ heptane hydrocarbons (paraffins), cycloparaffins (naphthenes), and a small amount of aromatics and olefins. It is preferable to limit the olefins to a typical bromine number of less than about 30 (about 10% by weight), but as an optimum to less than about 1% by weight, and the aromatics to less than about 25% by volume or an optimum of less than about 10% by volume in the fuel extender. It also may contain an approximate 50% ratio between the paraffins (heptanes) and cycloparaffins, with the paraffins not exceeding about 60% by volume and down to about 35%. The cycloparaffins may be within a range of about 40 to 60% depending on the source of crude. Naphtha of this content has a specific gravity within a range of about 0.7275 to 0.7467 and is a clear liquid of water-white color. A commercial solvent type naphtha sold by Ashland Oil Company, Specification No. 0368-40, under the trademark LACOLENE and typically having aromatics of about 2% plus, and olefins up to a maximum of about 0.5% by volume, is a suitable naphtha in this connection, as is LACOLENE that meets Federal Specifications TT-N-95A, aliphatic naphtha. It has been determined that our naphtha, in itself, without the other ingredients of our formulation, is not suitable for mixing or blending with commercial gasoline that is to be used in an internal combustion engine, since it is too low in octane performance to be used 100% interchangeably with commercial gasoline. Normal heptane has an octane rating of zero. Our formulation requires the use of all components with gasoline to create a suitable fuel. For ready reference, we are designating our naphtha as "naphtha Z"; its range of content in our extender is not less than about 6 parts to not more than about 10 parts by volume. The specific gravity of the additive solution will be substantially the same, that is within a range of not greater than about ±5% (±2% optimum) of the specific gravity of the commercial gasoline to which it is to be added.

It is important to note that methanol is not interchangeable with ethanol in our formulation for the following reasons: (1) methanol attacks and damages the carburization system components, etc.; (2) our naphtha Z is highly parafinnic in nature and will not blend by itself with methanol—they have no miscibility qualities whatsoever; (3) attempts to use methanol in place of ethanol results in a fuel without phase stability improvement of any kind; (4) in endeavoring to close the B.T.U. gap, a higher B.T.U. alcohol is needed. In summary, methanol and ethanol may be homologues, but their characteristics greatly differ.

In testing our formulated solutions prepared in accordance with the invention after blending with gasoline, only a minor wash-out alcohol was observed. The reaction of water in an unsatisfactory formulation on the other hand causes poor phase stability and a large increase in the quantity of mls. of a washed-out water-based layer at the bottom of a graduated cylinder. In our correctly formulated solution, a violent shaking of the mixture after the addition of water results in a quick clearing of the solution and a minimal increase in the bottom layer of water, and of water borne alcohols; this indicates a lack of crack-out (more than 50% of alcohol washed-out) and the full practicability of the proportioning involved.

On the basis of our experiments, the optimum content of the inventive solution composition comprises 1 part of ethanol (by volume), 7 parts of naphtha (by volume) and ½ to 1 part (by volume) of anhydrous isopropyl alcohol. A good operating range was found to be represented by approximately 1 part of ethanol, about 6 to 10 parts of naphtha and about ¼ to 1¼ parts of the isopropyl alcohol. A border line range of naphtha is between not less than 5 and not more than 11 parts. Too low an amount of naphtha causes poor phase stability and too high an amount tends to cause knock and ping. The percentage of the use of the formulated solution with gasoline, as an optimum, is within a range of about 60 plus parts of gasoline to 40 parts by volume of the solution or any higher percentage of gasoline. A working range of about 50 to 50 parts by volume has been successfully employed, but does not provide as smooth a running fuel as is obtained with a slightly higher percentage of gasoline.

It has been determined that in the proportioned solution including the gasoline, the alcohols lose much of their affinity for water absorption, their specific gravities are lowered from the standpoint of the resultant additive solution, and the B.T.U and burning qualities of the formulation very closely approximate that of unleaded gasoline. There is a balanced phase stability of the ingredients in the presence of water, and a fully miscible fuel is attained by mixing the solution with gasoline. The formulas herein set forth are based on the use of substantially full dehydrated (195 to 200 proof) alcohols.

In the following tables A and B of tests made, IW 12 represents a lesser desired formulation of the invention containing about 7 parts by volume of naphtha, 1 part by volume of ethyl alcohol and ½ to 1 part by volume of n-propyl alcohol. On the other hand, IW 14 represents the optimum formulation of the invention containing about 7 parts of naphtha by volume, about 1 part by volume of ethyl alcohol and about 178 to 1 part by volume of anhydrous isopropyl alcohol. Thus, the main difference between the two is that the higher alcohol is an n or an isopropyl alcohol. It will be noted from a study of Table A that the B.T.U. yield and the efficiency of a gasoline formulated solution mixture begins to fall into a less or unacceptable range when the volume of the formulated solution used is greated than about 50 to 50% with respect to the gasoline. When a special gasoline is manufactured for use with these formulas, higher ratios of our formulation with the special gasoline are practical.

Both anhydrous isopropyl and n-propyl alcohols have similar abilities to raise the octane rating of the formulation, but the isopropyl is more effective in improving the phase stability particularly in wet climates. They may be used in combination within the previously mentioned part range by volume.

We claim:

1. A homogenous combustion engine fuel formulation for blending with and use in commercial gasoline as an extender therefor in proportions of not greater than 50 parts by volume with respect thereto that is characterized by the stability of its alcohol content in the presence of water and its miscibility with and practicability for interchangeable usage with commercial gasoline; said formulation consisting essentially of naptha Z within a range of not less than about 6 to not more than about 10 parts by volume, about 1 part by volume of ethanol and about $\frac{1}{4}$ to $1\frac{1}{4}$ parts by volume of a higher alcohol of the class consisting of anhydrous isopropyl and or N propyl alcohol, wherein the specific gravity of the ingredients of the formulation is not substantially greater than the gasoline to which it is to be added, wherein the premixed solution of ingredients is less soluble in water than ethanol, itself, and wherein its ingredients in the defined proportions as an extender for commercial gasoline have a substantially full phase stability therein.

2. A fuel extender as defined in claim 1 wherein its ingredients in solution are within a range of specific-gravity of not greater than $\pm 5\%$ of the specific gravity of the gasoline to which the solution is to be added.

3. A fuel extender as defined in claim 1 wherein the specific gravity of the formulation is within a range of about 0.72 to 0.77.

4. A fuel extender as defined in claim 1 wherein the specific gravity of the naphtha Z is within a range of about 0.7275 to 0.7467, and the higher alcohol content within the specified range includes n-propyl alcohol.

5. A fuel extender as defined in claim 1 wherein it is in an amount of not greater than about 40 parts by volume to 60 parts by volume of commercial gasoline to be used for engine fuel.

6. A homogeneous combustion engine fuel extender formulation for blending with and use in gasoline as a partial substitute therefor in proportions of not greater than about 40 parts by volume with respect thereto that is characterized by the stability of its alcohol content in the presence of water and its miscibility with and a substantial retention of engine operating characteristics as present with commercial gasoline; said formulation consisting essentially of a low octane aliphatic naphtha consisting of C7 heptane hydrocarbons, cycloparaffins, and a small amount of any aromatics and olefins wherein the heptane hydrocarbons and the cycloparaffins are within an approximate ratio of about 50% each in the naphtha, and wherein the naphtha is in an amount of not less than about 6 to not more than about 10 parts by volume in the formulation; said formulation also consisting essentially of about 1 part by volume of substantially dehydrated ethanol, and about $\frac{1}{4}$ to $1\frac{1}{4}$ parts by volume of a higher alcohol of the class of anhydrous isopropyl; wherein the specific gravity of the ingredients of the formulation is not substantially greater than about $\pm 2\%$ of the gasoline to which it is to be added, and wherein all of the ingredients of the formulation as premixed in the defined proportions as an extender for commerical gasoline have a substantially full phase stability therein.

7. A fuel extender as defined in claim 6 wherein the heptane hydrocarbons are within a range of about 35 to 60% by volume and the cycloparaffins are within a range of about 40 to 60% by volume within the naphtha.

8. A fuel extender as defined in claim 7 wherein the specific graity of the naphtha is within a range of about 0.7275 to 0.7467.

9. A fuel extender as defined in claim 7 wherein the specific gravity of the extender formulation is about 0.72 to 0.77.

10. A fuel extender as defined in claim 7 wherein the anhydrous isopropyl alcohol is within a range of content of about $\frac{1}{2}$ to 1 part by volume in the extender formulation.

11. A fuel extender as defined in claim 7 wherein the aromatics are present in the naphtha in a maximum amount of about 5% by volume, and the olefins are present in a permissible maximum of up to about 0.5%.

* * * * *